United States Patent [19]

Tall et al.

[11] 3,933,069

[45] Jan. 20, 1976

[54] CAMERA FILM PROCESS FILM LOCATING FEED AND CUTTER

[75] Inventors: Leonard H. Tall, Mercer Island; Gerald L. Edwards, Seattle, both of Wash.

[73] Assignee: CX Corporation, Seattle, Wash.

[22] Filed: Feb. 6, 1975

[21] Appl. No.: 547,379

[52] U.S. Cl. ..... 83/210; 83/362; 83/365; 83/367; 83/371

[51] Int. Cl.[2] ..... B26D 5/32; B26D 5/34

[58] Field of Search ..... 83/210, 209, 211, 365, 83/362, 367, 371

[56] References Cited

UNITED STATES PATENTS

| | | | |
|---|---|---|---|
| 3,469,480 | 9/1969 | Nassenstein et al. | 83/365 X |
| 3,763,728 | 10/1973 | Blackman | 83/210 |
| 3,796,117 | 3/1974 | Mukai et al. | 83/210 |

*Primary Examiner*—Frank T. Yost
*Attorney, Agent, or Firm*—Christensen, O'Connor, Garrison & Havelka

[57] ABSTRACT

A camera film locating feed system for processing of film strips utilizing locating holes in the film that have or tend to undergo trailing edge damage due to mishandling of the camera when the film is being advanced from one frame setting to the next. In feeding such film in the processing device a selectable control means detects film positioning by reference to the leading edge of each locating hole with the film in one orientation in the processor, and by the lagging edge with the film inverted or oppositely oriented in the processor, and rejects false detection control signals from certain kinds of locating hole damage by the delaying action of a control means gate.

7 Claims, 10 Drawing Figures

LAGGING EDGE CONTROL

LEADING EDGE CONTROL

CAMERA FILM PROCESS FILM LOCATING FEED AND CUTTER

BACKGROUND OF THE INVENTION

The invention relates to apparatus in which camera film or other strip material may be fed or advanced longitudinally by controlled amounts or into predetermined successive positions in processing apparatus such as film cutters, printers, markers or notchers. The invention is herein illustratively described by reference to its preferred application, namely as a positioning feed for camera film cutters, wherein the film is of the type having locating holes spaced at intervals along one edge of the film and utilized in operation of the camera to stop the film at each successive exposure frame positions. In the illustrative cutter system such locating holes are used to control actuation of the cutter blade as a function of film advance positioning.

A broad object of this invention is to devise a film strip positioning feed device recurringly operable in response to detection of successive film locating holes in such manner as to position the film accurately in the cutter or other processor regardless of distortion and damage of the locating hole edges that typically may occur with some films due to mishandling of the camera.

In some cameras the film strip is advanced into its first and succeeding exposure frame positions through manual rotation of a take-up spool until a dog in the camera drops into one of a series of locating holes along an edge of the film and thereby arrests the film against further advancement by continued application of torque to the take-up spool. Once the pawl catches the trailing edge of a locating hole, the film continues to be thus held until the camera shutter is actuated and thereby releases the pawl. Forceful attempts to advance the film further against resistance of the pawl will permanently tear or otherwise distort the film at the trailing edge of the film locating hole. Yet, persons inexperienced or careless in camera operation will evidently attempt to overcome resistance of the pawl because considerable film damage is seen in the processing laboratories. Although films sustaining such hole damage may be printable, cut and packaged if specially handled, nevertheless they present a serious problem to the processor desiring to do precision work using automated processing equipment.

Camera film of the type described is typically premounted stretched ready for use between supply and take-up reels enclosed in a light-proof plastic cassette designed for compact pocket-size cameras. In the commercial processing of such film the plastic cassette casings are broken open to remove the film, the exposed film developed, the developed film strips spliced end-to-end with others and wound on a large storage reel that feeds it through a printer. It is next advanced through a mechanized or automated cutter that typically severs it into lengths of four exposure frames each, a size that can be conveniently handled and packaged in an envelope for delivery to the customer.

The successive film strips are all similarly oriented when spliced together and wound on the storage reel. However, some processing devices are designed to accept the film with the emulsion side up and some with the emulsion side down. As a result the edge of each locating hole in the film which was a leading edge in advancing the film through the camera can become either a leading edge or a lagging edge when the film is being advanced through the processing device, depending upon the type of equipment in use. Thus locating hole edge damage presents a significant problem in locating the film precisely in the processor during film feed unless means are employed to identify and operate selectively in response only to the undamaged hole edges and to ignore or reject all other effects. Heretofore, film position feed devices attempting to work with such camera-damaged film have either not been designed in recognition of this problem or have not effectively dealt with it. As a result imprecise positioning of the film has caused an inferior product. For example, with some prior feed devices, locating hole edge damage in the film could cause a cutter to make it cut within the borders of an exposure instead of down the middle of the narrow zone between successive exposure frames as desired.

Therefore, a further object hereof is to provide film strip feed means wherein consistent reliability of film positioning through the aforesaid selective detection with reference to the undamaged locating hole edges will not be impaired by false detection signals due to jagged rents in a damaged edge falsely simulating the good edges of a succession of locating holes as sensed by the sensing means.

Still another object of this invention is to devise a camera film positioning feed and control means adapted for use with any of different commercially available film cutters or other processing devices, regardless of film orientation required therein.

A further object hereof is to devise a high-speed and reliable apparatus which itself handles the film without marring or otherwise damaging the film.

BRIEF DESCRIPTION OF THE INVENTION

In accordance with this invention, locating hole edge detector means operable in predetermined positional relation to a film processing device scans the advancing strip and provides locating hole detection pulses including leading and lagging edge type signals selectively detected and utilized to actuate the cutter or other processor, the proper type signal being selected in accordance with a circuit setting made beforehand depending upon whether the emulsion side of the film is placed up or down in the processing equipment.

As a further feature, a delay gate is generated in timed relation to each processor actuation signal, which gate spans a feed interval sufficient to reject false or undesired hole edge detection signals received from the detector means. Preferably a stepping motor film feed is used and the duration of such gate is established through a digital count of pulses energizing the stepping motor.

The foregoing and other features, objects and advantages of the invention will become more fully evident from the description which follows by reference to the accompanying drawings.

DETAILED DESCRIPTION WITH REFERENCE TO DRAWINGS

Figure 1:
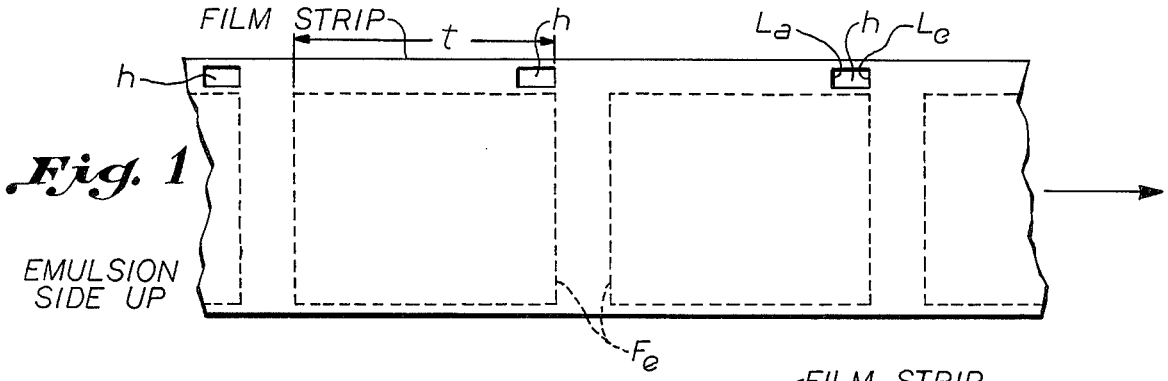
FIG. 1 is a face view of a short length of camera film strip illustrating the presence of locating holes along one edge of the strip in relation to exposure frame locations on the strip.
Figure 2:
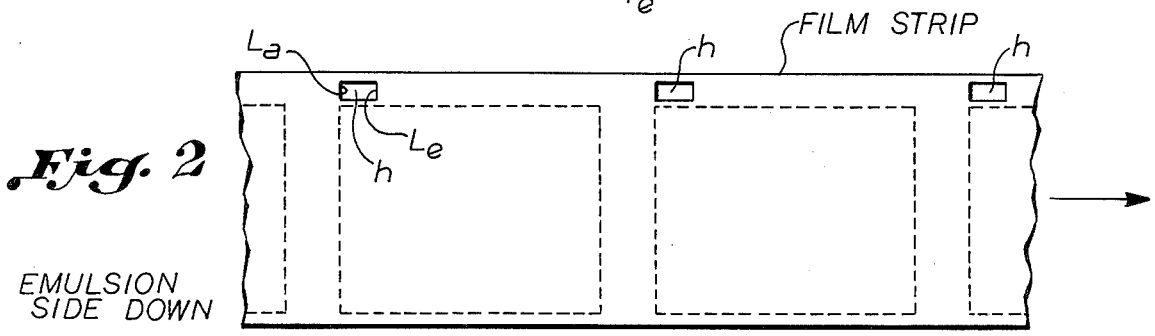
FIG. 2 is a similar view with the film strip inverted so as to move through the processing apparatus in the same direction as in FIG. 1 but with the opposite end of the film leading, as it does in some processors.

As depicted in FIGS. 1 and 2, a camera film strip of the type to which the invention applies in this example comprises the usual elongated thin plastic sheet strip upon face of which there is a coating of photographic emulsion and along one edge of which locating holes of rectangular configuration are formed at regular intervals positionally related to the desired exposure frame areas F*e* shown by dotted lines in the Figures. With the film advanced lengthwise with one orientation in the processing apparatus, the locating holes *h* have one positional relationship with the associated exposure frame areas F*e;* whereas with the film inverted in the apparatus, thereby keeping the locating holes F*e* on the same side in the apparatus, the locating holes occupy a different relative position to the respective exposure frame areas (compare FIGS. 1 and 2). Thus, the terminal edges of the locating holes which are the leading and lagging edges L*e* and L*a* with the film orientation as shown in FIG. 1 become respectively the lagging and leading edges with the inverted orientation as depicted in FIG. 2. When a cartridge of such film is loaded in a camera of the type mentioned, however, the film is always advanced unidirectionally to make the successive photographic exposures, so that it is always the same locating hole terminal edge that becomes damaged by the positioning pawl or dog in the camera that stops the film in the correct frame exposure position for each picture to be taken. Thus, when such film after exposure and development is spliced together with others and fed through processing apparatus there would be no problem with detecting the position of locating holes if the detector used could be made to respond for example only to a leading edge or only to a lagging edge of the film, namely the undamaged or undistorted edge of each locating hole. In fact, however, the processing devices of different manufacturers and for different applications require different film orientations. Consequently precise successive positionings of the film during processing in all such apparatus requires means to detect and operate upon the positioning of only the unmarred locating hole edges regardless of which end of the film is leading during film advancement.

Figure 3:
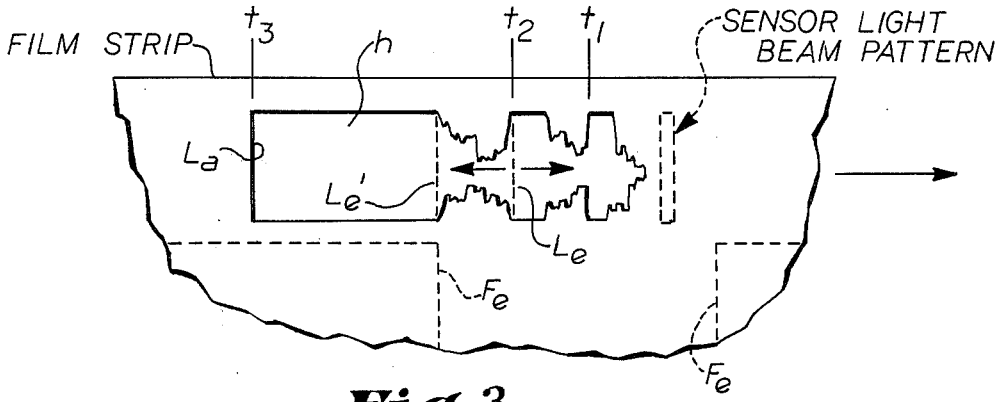
FIG. 3 is an enlarged face view of a fragmentary portion of film strip showing one kind of locating hole edge damage that can occur in a camera and illustrating the relationship of incident light of a photoelectric sensor which detects the leading and lagging edges of the locating holes by scanning the line of holes as the film is being advanced through associated processing apparatus.

In FIG. 3 there is shown a fragmentary edge portion of a film strip having a locating hole *h* having one rim edge that undamaged and its opposite rim edge badly torn due to excessive film tension resisted by the camera positioning pawl or dog. In FIG. 3 with the film to be advanced in processing apparatus in the direction of the arrow, the unmarred hole extremity L*a* is the lagging extremity, whereas the opposite nominal extremity or terminal edge L*e'* is no longer intact but has been torn through, leaving a series of irregular rents variable in width and extending beyond the nominal hole terminus L*e'*. This type of damage to the film makes the true leading edge location of the locating hole indefinite as depicted by the double arrow. Each abrupt widening of the tear or rent thus produced, such as at locations *t*1 and *t*2 can have the effect of a separate locating hole leading edge as sensed by a detector, such as a reflected light beam sensor which projects a narrow transversely oriented line pattern of light upon the film as shown in the figure, which light is reflected and photoelectrically detected. These false locating hole leading edge extremities vary in distance from the lagging edge extremity *t*3 and thus signals therefrom cannot be used, and in fact must be rejected, for precise positioning of film advanced in processing apparatus.

Figure 4:
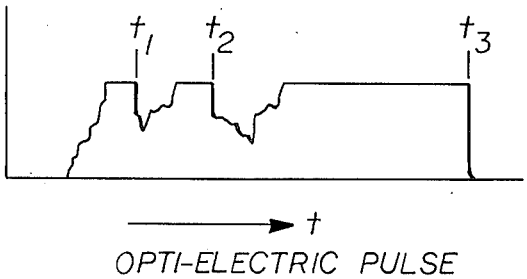
FIG. 4 is a time (film travel) diagram of an electrical signal produced by the photoelectric sensor in scanning a locating hole of the configuration shown in FIG. 3.

FIG. 4 depicts approximately the photoelectrically sensed signals that would accrue from hole scan by a line pattern light beam reflected from film advanced in the manner depicted in FIG. 3. The signal steps or transient changes at *t*1, *t*2 and *t*3 in FIG. 4 correspond to the abrupt changes in reflectance of the film-hole areas being scanned by the stationary light beam pattern as shown.

Figure 5:
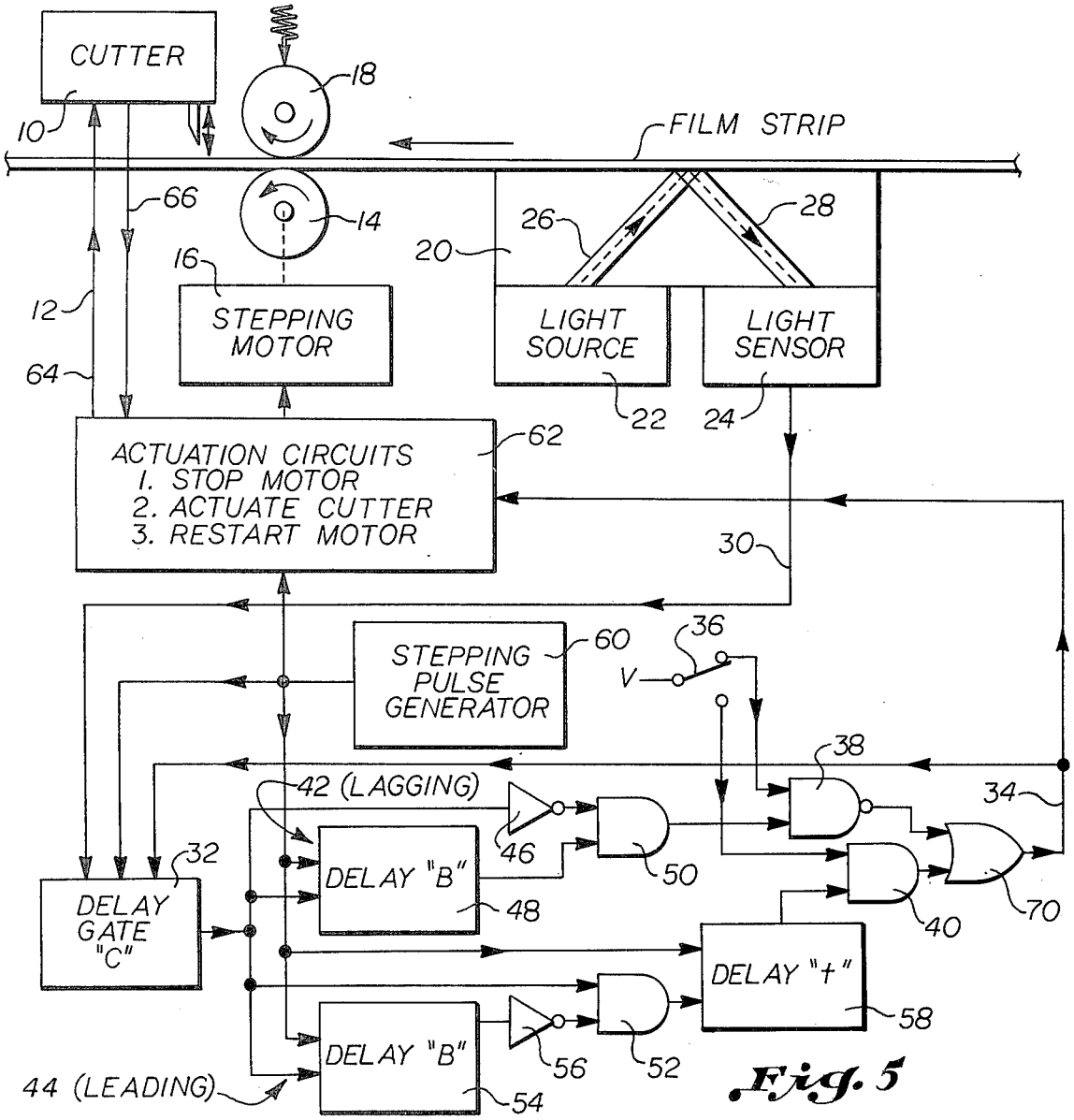
FIG. 5 is a simplified schematic illustrating a preferred embodiment of the invention applied to a film positioning feed and associated film cutter.

In FIG. 5 the problem is overcome by apparatus in which the film strip is fed to a film cutter 10 actuatable by an electrical impulse applied through conductor 12 each time the film is to be cut transversely of its length. In lieu of a cutter, the apparatus may be operated in conjunction with other processor devices such as a printer, marker or a notcher. In each instance and for each application, it is of course important that the film being advanced through the apparatus, as in the direction of the arrow, be stopped precisely at the correct position or that the cutter or other operating element be actuated precisely in the correct timed relationship to advanced position of the film.

The film strip is advanced to cutter 10 by means of a power driven frictional roll 14 turned through progressive increments by a stepping motor 16 designed typically to advance the film by 64 steps or increments per inch of travel. Such stepping motors and stepping motor feeds are well known in the art. An opposing free-turning presser roller 18 establishes the desired friction force of film against feed roller 14 to avoid significant slippage in the drive. The roller 14 draws the film past locating hole detector means comprising a sensor device 20 which includes a light source 22 and an associated reflected light sensor 24. Light from source 22 is directed at an incline upwardly against the undersurface of the film strip through a transverse line array of fiber-optic elements 26 and the resultant light incident upon the film is reflected downwardly from the film surface through a counterpart array of fiber-optic elements 28 into a suitable light sensor 24 which coverts the receive light into an electrical effect such as voltage, current or change of resistance representing a detection pulse presented to circuit conductor means 30. The fiber-optic arrays 26 and 28 pattern the light incident upon the film and the reflected light received from the film in a transverse straight-line pattern as depicted in FIG. 3 spanning transversely across the path of advance of the locating holes *h* and preferably of a pattern width transverse to the film approximately equal to the locating hole width so as to produce a maximum excursion of signal intensity variation in conductor 30 each time the end extremity or edge of a locating hole passes the light beam.

If, for the moment, one ignores the effect of delay gate 32, later to be described, and assumes the signal on conductor 30 is passed directly to the control circuits for processing, those circuits produce a control pulse on conductor 34 in response selectively either to a trailing edge or to a leading edge of a locating hole passing the line of incidence of sensor light upon the reflecting lower surface plane of the advancing film strip. Whether it is the leading edge or the trailing edge signal from light sensor 24 that produces the operating pulse on conductor 34 depends upon the setting of a selector switch 36 applying energizing voltage to AND gate 38 or alternatively to AND gate 40. AND gate 38 is in the lagging edge control circuit channel 42, and AND gate 40 is in the leading edge control circuit channel 44. In lagging edge control channel 42 the terminal ends of the nominally rectangle-shaped impulses transmitted by conductor 30 from the light sensor are selectively processed so as to produce a control impulse on conductor 34. The leading edge circuit channel 44 processes the leading or initial ends of such impulses to produce a control impuse on conductor 34.

In lagging edge control channel 42 the nominally rectangular pulse from conductor 30 is divided into parallel paths, one including an inverting amplifier 46 and the other a delay circuit 48, respectively connected to the input terminals of AND gate 50, in turn delivering its output to the active input of AND gate 38. Similarly in leading edge control channel 44, the rectangular pulses delivered by conductor 30 are divided into parallel paths, one connected directly to one input of AND gate 52 and the other to the other input of such AND gate through delay circuit 54 and inverting amplifier 56. Preferably the amount of delay B interposed by each of circuits 48 and 54 is the same, and conveniently represents the time interval between successive pulses from the stepping pulse generator 60 which supplies the drive initiation pulses for the stepping motor 16.

The output of AND gate 52 is passed to the active terminal of AND gate 40 through still another delay circuit 58 which in this instance interposes a time delay, measured in a counted number of pulses from stepping pulse generator 60, corresponding to the feed distance interval *t* depicted in FIG. 1, FIGS. 1 and 2 being drawn in positionally registry for the purpose of illustrating the significance of the distance interval *t.* This distance interval represents the greater distance by which film must advance to the cutter 10 from the location of the light sensor or edge detector when the latter is operating upon the leading edge of each locator hole (as in the case of the film orientation shown in FIG. 1) than it travels when the system operates on the lagging edge of the locator holes, in order to have the correct place on the film aligned in precise registry with the cutter blade at the instant the cutter is actuated in response to a control or command pulse on conductor 34. A pulse counter in delay circuit 58 is designed or set to a count that achieves this exact amount of delay interval (distance) *t.*

Control pulses on conductor 34 pass to actuation circuits 62 in the control means of the system which in response to each such pulse initiate an actuation sequence utilizing any suitable or known circuit techniques for the purpose. The first step in that sequence is a response which stops the stepping motor 16 by initiating retardation and then positive arresting of movement such that the drive roller 14 stops turning altogether after a precisely measured amount of travel after application of the control pulse or conductor 34. Typically, eight stepping pulses from generator 60 are required to stop the motor 16 in response to a conductor 34 control signal. Assuming the stepping motor produces film travel at the rate of 64 increments of steps per inch, the film travels precisely one-eighth of an inch before it stops after incidence of the control signal. A counter in the actuation circuit 62 then produces a cutter actuation impulse on conductor 64 in response to counting out the eight pulses necessary to stop the stepping motor 16, and the film is severed at the precisely established position produced in the operating sequence. A cutter feedback signal on conductor 66 fed to actuation circuits 62 restarts the motor 16 by reestablishing the energizing path from stepping pulse generator 60 to the motor through the actuation circuits 62. In lieu of feedback through conductor 66 a simple counting arrangement in the actuation circuits may be used to restart the motor at the desired instant if desired.

Figure 6:
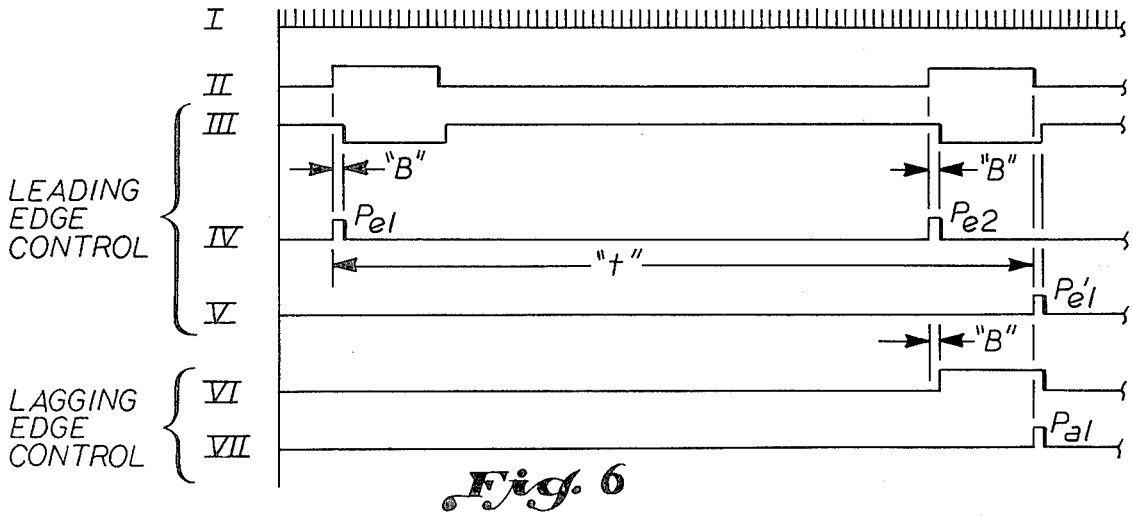
FIG. 6 is a time (film travel) diagram illustrating operation of the film positioning feed shown in FIG. 5 with delay gate C eliminated, which it might be for the processing of film having minimal locating hole edge damage or distortion.

The pulse sequence diagram depicted in FIG. 6 aids in the understanding of operation of the film positioning feed depicted in FIG. 5 absent the affect of delay gate 32, as aforementioned. The stepping motor drive pulses initiated by stepping pulse generatr 60 are depicted in line I, and assuming the film is moving incrementally at a steady rate and the locating holes being scanned by the light sensing detector 20 have clean or undistorted leading and lagging edges the resulting electrical pulses produced at conductor 30 appear as rectangular pulses in line II. The duration of these positive-going pulses with steep leading and lagging edges corresponds to the film travel interval from the instant a locating hole leading edge passing the light beam to the instant the lagging edge passes the light beam. Diagram line III represents the inveerted pulse from conductor 30 applied to the lower terminal of AND gate 52 whereas line IV shows the resultant differential pulses P*e*2, - - -, produced in sequence at the output of AND gate 52. Line V depicts the latter pulses at the output of delay circuit 58, delayed by the interval *t*, fed by AND gate 40 to OR gate 70 which produces the control pulses on conductor 34.

In the case of leading edge control established by positioning of selector switch 36 in its alternative or lower position shown in FIG. 5, if switch 36 is switched to its upper position so that the lagging edge channel becomes operative to produce the control pulses on conductor 34, the locating hole rectangular pulses appearing in graph line VI delayed in circuit 48 by the interval B combine in the AND gate 50 with the inverted but delayed pulses from amplifier 46 to produce the control pulses P*a*1, P*a*2, - - -, as depicted in line VII in FIG. 6. The alternative switching of the control means circuits thus automatically compensates for the positional shift of locating hole relative position by the interval *t* as depicted comparatively in FIGS. 1 and 2 as aforesaid.

Figure 7A:
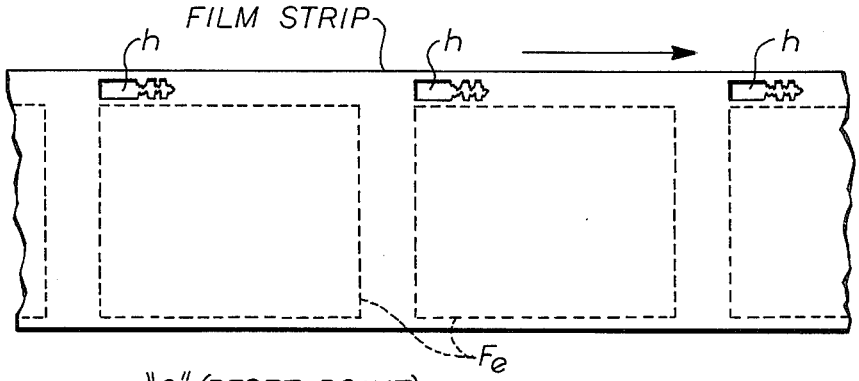
FIGS. 7*a* and 7*b* are time (film travel) diagrams illustrating operation of the system shown in FIG. 5 with delay gate C acting to prevent false operation of the cutter due to more severe locating hole damage, such as by tearing as depicted in part *a* of the Figure, with the film being advanced with a first end leading.
Figure 7B:
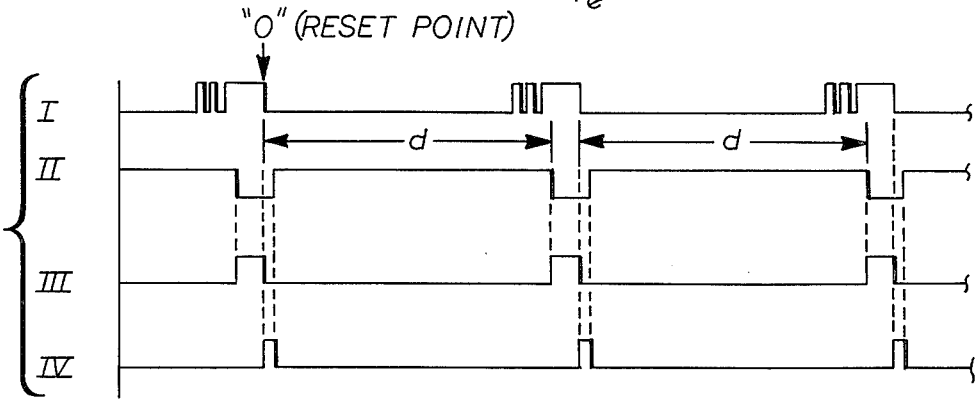
Figure 8A:
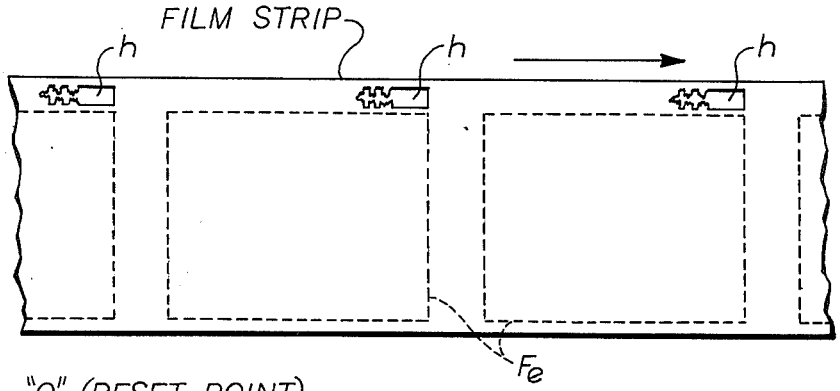
FIGS. 8*a* and 8*b* are similar diagrams showing the effect of delay gate C with the film being advanced with its opposite end leading.
Figure 8B:
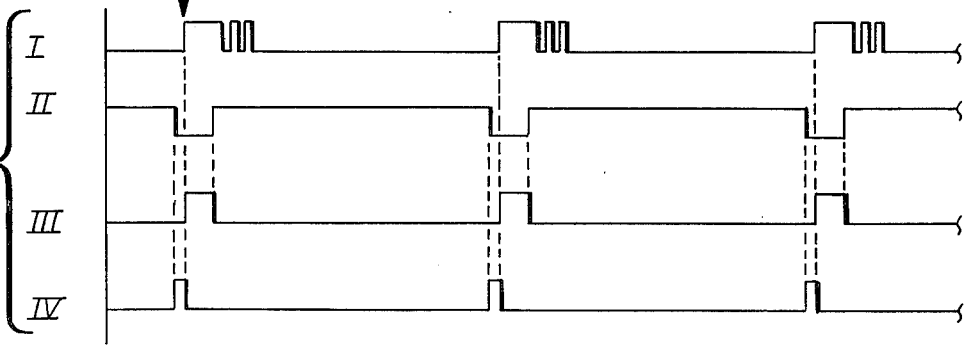

Now in order to render the system insensitive to irregular tears or rents in the film strip (FIG. 3) caused by the camera stop dog, delay gate circuit 32 shown in FIG. 5 imposes an additional delay function or interval C upon the conductor 30 pulses applied to both the leading anad lagging edge control channels 44 and 42 respectively. In FIG. 7 the operating condition depicted is for film positioned in the processor for movement with that end leading which causes the damaged edges of the locating holes *h* to be in leading position as depicted in FIG. 7*a*. In the timing-pulse diagram depicted in FIG. 7*b* the light sensor output pulses corresponding to such damaged holes in the film are shown in diagram line I wheres in line II the delay gate intervals *d* produced in circuit 32 are shown in relation to those pulses. The portion of the composite hole pulse permitted to pass delay gate 32 is depicted in line III and will be seen to include the lagging hole edge portion of the pulse, which is to comprise the reference signal. The jagged hole signals. are blocked. The resultant output pulse on conductor 34 appears in line IV. To perform this gating function that excludes false (hole damage) signals, delay gate circuit 32 includes a pulse counter responsive to pulses from the stepping pulse generator 60. The start of the count, and initiation of the delay gate interval *d* is triggered by the control pulse on conductor 34, or initially by a reset (i.e., zero start) condition applied to the delay gate circuit 32. The duration of the count, representing the duration of gate interval *d* in terms of film advance movement, is established by the setting of a counter (not shown) in delay gate circuit 32 in conventional manner and is used to control the gate in the manner indicated. As depicted in FIG. 8*b* the same count cycle and delay gate function is employed when the control system is set in its alternative or hole leading edge control mode corresponding to the inverted position of the film in the processing equipment, so that the undamaged hole edges are the leading edges as depicted in FIG. 8*a*.

It will therefore be apparent that the system of control of a film processing device by the novel film feed positioning detector and control circuits achieves precise location of the film in relation to the cutter or other processing device used independently of whether the film is positioned in the processing apparatus to advance with one end leading or inverted and with the other end leading. Moreover, it will be apparent that other or similar specific implementation of the system components may be employed to achieve a similar result in similar manner. For example, the locating hole edge detection function is illustrated as being performed by a photoelectric light reflection technique employing a light beam that scans the advancing film whereas other forms of detectors may be used to the same end. Particular advantages are achieved with such a detector and use of a stepping motor and roller drive. The stepping motor control pulses may then be advantageously utilized in performing the desired timing functions by which the various film travel delays utilized in the apparatus are achieved. These and other variations, although less preferred, are deemed to be within the scope of the broad concepts of the invention.

What is claimed is:

1. Processing apparatus comprising in combination with feed means for longitudinally advancing camera film strip and the like longitudinally therein with either end leading, processing means at a processing station for performing a processing operation on the strip at each of successive positions of advancement thereof by said feed means, said strip having locating elements successively spaced lengthwise along the strip each with opposing first and second longitudinally spaced terminal edges, corresponding first ones of such edges occupying predetermined longitudinal positions on the strip and the corresponding opposing edges longitudinal positions subject to variation, edge detector means operable in predetermined positional relation to the processing station to scan the advancing strip locating elements and provide therefrom first signals from detection of the respective leading ones of such edges and second signals from detection of the respective lagging edges thereby scanned, and control means selectively operable to actuate the processing means in response to each of the leading edge signals with the strip being advanced with one end leading, and alternatively operable to actuate such operating means in response to the lagging edge signals with the strip being advanced with its other end leading.

2. The combination defined in claim 1, wherein the strip comprises camera film having a succession of exposure frames spaced at regular intervals longitudinally of the film strip, and the locating elements comprise holes therein spaced along one margin at regular intervals and positionally related to the exposure frames, at least some corresponding edges of such locating holes leading in one direction of film advancement having been subject to deformation.

3. The combination defined in claim 2, wherein the processing means comprises a film cutter adapted to sever the film transversely into predetermined lengths between exposure frames.

4. The combination defined in claim 2, wherein the feed means are operable to advance the film in a single direction therein, and to receive the film in either of relatively inverted positions in said feed means so as to advance the film with either edge leading in said single direction of advance.

5. The combination defined in claim 4 wherein the feed means comprises a stepping motor drive and a source of recurring pulses for energizing the drive, operable to advance the film through each exposure frame interval in a predetermined plurality of predetermined length increments, said control means including first delay means responsively connected to said pulse source to provide a first delay interval during which signals from the detector means are prevented from operating the control means, said delay interval approximating the locating hole interval, said delay interval being initiated in timed relation to each operation of the processing means, thereby preventing false operation of the processing means by signals from hole edges deformed through prior tearing of the film.

6. The combination defined in claim 5 wherein the control means further includes a second delay means responsively connected to said pulse source and operable to selectively delay operation of the processing means by the control means in response to hole leading signals by an interval equal to the film advancement interval between the leading edge of one hole and the next succeeding hole's lagging edge if the latter edge is undeformed.

7. The combination defined in claim 6, wherein the apparatus comprises a film cutter.

* * * * *